US005934990A

United States Patent [19]

Steffenino et al.

[11] Patent Number: 5,934,990

[45] Date of Patent: Aug. 10, 1999

[54] MINE STOPPING

[75] Inventors: John E. Steffenino; Timothy J. Shean, both of Bristol, Tenn.; C. Dempsey Holstein, Jr., Hilltop, W. Va.; Joseph C. Zelanko, Cranberry Township, Pa.

[73] Assignees: The Tensar Corporation, Atlanta, Ga.; Sandvik Rock Tools, Inc., Bristol, Va.

[21] Appl. No.: 08/834,389

[22] Filed: Apr. 16, 1997

[51] Int. Cl.[6] ..... E21F 1/14

[52] U.S. Cl. ..... 454/170; 523/130

[58] Field of Search ..... 454/169, 170; 299/12; 523/130

[56] References Cited

U.S. PATENT DOCUMENTS

| | | | |
|---|---|---|---|
| 3,302,343 | 2/1967 | Bear . | |
| 3,972,272 | 8/1976 | Bagby | 454/169 |
| 4,096,702 | 6/1978 | Burton | 454/169 X |
| 4,374,798 | 2/1983 | Mercer . | |
| 4,398,451 | 8/1983 | Werthmann | 454/170 |
| 4,530,622 | 7/1985 | Mercer . | |
| 4,607,066 | 8/1986 | Barry et al. . | |
| 4,687,790 | 8/1987 | Andreichuk . | |
| 4,992,003 | 2/1991 | Perach . | |
| 5,043,019 | 8/1991 | Chervenak et al. . | |
| 5,091,247 | 2/1992 | Willibey et al. . | |
| 5,096,335 | 3/1992 | Anderson et al. . | |
| 5,108,224 | 4/1992 | Cabaniss et al. . | |
| 5,147,150 | 9/1992 | Berkhout et al. . | |
| 5,156,496 | 10/1992 | Vidal et al. . | |
| 5,165,958 | 11/1992 | Plaisted et al. . | |
| 5,167,474 | 12/1992 | Kennedy et al. . | |
| 5,199,825 | 4/1993 | Travis . | |
| 5,236,499 | 8/1993 | Chervenak et al. . | |
| 5,249,893 | 10/1993 | Romanek et al. . | |
| 5,277,520 | 1/1994 | Travis . | |
| 5,401,120 | 3/1995 | Hussey et al. . | |
| 5,472,297 | 12/1995 | Heselden . | |
| 5,725,327 | 3/1998 | Hussey et al. . | |

FOREIGN PATENT DOCUMENTS 06294142 10/1994 Japan .

*Primary Examiner*—Harold Joyce

*Attorney, Agent, or Firm*—Jacobson, Price, Holman & Stern, PLLC

[57] ABSTRACT

A mine tunnel ventilation control device and method for constructing same quickly with an easily transportable matrix material to provide a rigid flame retardant barrier wall. The air flow stopping includes a peripheral frame extending about and across a tunnel opening to which is secured a matrix material, preferably in the form of a composite including a sheet of very strong grid material, such as a biaxially oriented integral geogrid or the like, bonded to a sheet of a textile material, such as a non-woven, needle punched, geofabric or the like which spans the apertures of the geogrid. At least one side of the matrix material, and preferably both sides, are covered with a sealant composition to prevent passage of air through the mine stopping and to develop structural rigidity.

11 Claims, 6 Drawing Sheets

MINE STOPPING

FIELD OF THE INVENTION

The present invention relates to the construction of ventilation control devices or "stoppings" in one or more tunnels of an underground mine to direct ventilating air alone prescribed paths. The preferred mine stopping of this invention comprises a grid composite mounted on a frame which spans the tunnel opening and is coated on at least one side with a sealant to prevent air flow therethrough and, preferably, to provide additional flame retardant properties.

BACKGROUND OF THE INVENTION

The recovery of minerals from beneath the ground dates from prehistoric times. For thousands of years mining consisted of the excavation of outcropping material or tunneling more or less horizontally into mountainsides. Mining from deep shafts became possible only when reliable supports for tunnels along with drainage, ventilation and the use of mechanical appliances were developed.

Methods for the mining of mineral deposits differ from one another because of differences in geological conditions and location. However, all underground mines have certain features in common. Access to the deposit is gained either by a horizontal tunnel driven into a mountainside, a diagonal shaft to access the deposits, or by a veltical shaft. The deposit is then generally divided into sections of suitable size and shape for mining. When the mineral deposit extends to great depths as is common, for example, in coal mines, multiple horizontal tunnels may be formed from a vertical shaft, sometimes spaced from each other at intervals of as much as 300 feet. After extensive preparatoly work has been done. the actual mining may commence.

One well established method for the mining of sedimentary deposits occurring, in coal seams is known as "long wall mining". By this method, coal is obtained from a continuous wall of up to 200 yards long or longer by removal of a web of coal about 3 feet wide by the seam height. Areas of several hundred acres may be completely extracted.

Two variants of this method are in use. In the "retreating" system, roads are driven to the boundaries of the area to be mined. The faces are worked retreating to the panel heading. In the "advancing" system, the faces are opened up at the panel heading and then advanced to the boundaries.

In the United States the "room-and-pillar" method of coal mining is extensively used. Main entries are first made and from them rooms are driven. Between 30 and 50% of the coal is mined in this way during the "first working". Subsequently, the pillars of coal remaining are mined in the retreat, or "second working".

With either system, the passageways formed during the mining operation provide another critical function, namely, they enable ventilation of the mine. Ventilation in a mine is important for three main purposes: to provide fresh air to the miners, to dilute, render harmless and carry away, any potentially hazardous gases, dust, smoke and fumes that may be underground and, since underground temperature rises with increasing dental on an average of about 1° C. for every 30 m (100 ft.), the ventilating air lowers the naturally occurring heat of the rock.

Horizontal-tunnel mining associated with hard mineral extraction usually relies on natural ventilation by utilizing a difference in air pressure between openings at different levels of the mine. In deep coal mining, however, it is generally necessary to use fans of very large size, drawing, perhaps, 20,000 $m^3$ (700,000 $ft.^3$) of air per minute, installed at air-extraction shafts at an edge of the mined area in order to provide adequate ventilation.

The fresh air descends by negative pressure to the lowest levels of the mine and is heated or cooled by the natural heat of the rock. The ventilation air makes its way by various paths to the suction zone of the main extraction way or shaft, in which suction pressures of up to 400 mm (17 in.) water gauge may be maintained.

Parts of the mine that are not effectively serviced by forced ventilation may shave to be provided with an additional or auxiliary ventilation system. For this purpose air may be impelled by powerful fans through large-diameter ducts located in the mine. Proper functioning of this auxiliary system has to be supervised and controlled with considerable care and cost. Accordingly, use of auxiliary ventilation is minimized, where possible.

Thus, it will be recognized that ventilation air is a critical component of all underground mining operation. It is important that the air be provided to all portions of the mine in use; however, considering the cost of providing and circulating, the air. it is also commercially important to insure that ventilating air is not wasted.

Generally diagrams, including data on airflow conditions, are prepared for each section of the mine. For reasons of safety, the main air flow is split up into the largest possible number of circulating currents. It is essential to prevent "short circuits" which cause the air to take a shortcut and, thus, bypass certain parts of the mine. Distribution of the fresh air over the various levels, main roadways, crosscuts, rooms and workings is assisted by ventilation doors (designed as air locks), seals, stoppings, air crossings and other devices.

While such ventilation controls must be readily constructed in an inexpensive manner, they must still be substantially air tight and strong enough to prevent passage of high pressure air. Additionally, they must be relatively rigid, yet flexible enough to withstand significant pressure differential, on the order of 39 $lb/ft^2$, and be flame retardant.

Currently, a stopping is commonly accomplished by building a mortarless cinder block wall and then coating the wall surface(s) with a sealant to provide strength and integrity to the wall, to add flame retardant insulation, and/or to reduce airflow, through the wall. Particularly useful sealant or coating materials for such mine stoppings, are described in U.S. Pat. Nos. 5,043,019 and 5,236,499, assigned to Sandvik Rock Tools. Inc. of Bristol, Va., ("Sandvik"), the disclosure of each of which is hereby incorporated herein in its entirety by reference. A preferred Sandvik sealant of a paste-like consistency adapted to be coated on the wall by hand is formed of about 1.8 to about 20% by weight of a water soluble silicate as a binder, about 3.6 to about 46% water as a diluent, about 0.01 to about 0.3% reinforcing filler fibers, up to about 48% clay as a texture filler, and about 1 to about 73% limestone to speed up the drying rate. With about 1.8 to 28% silicate, about 3.6 to about 50% water, about 0.08 to about 5% fibers, up to about 50% clay, and from about 1 to 73% limestone, the sealant may be provided in sprayable form.

A dry-stack concrete block wall constructed in this mariner can be made quite rigid by the sealant and possesses good flexural strength. However, construction of mine stoppings from concrete blocks or the like is labor intensive and, in many situations, quite difficult. The need to transport large numbers of concrete blocks to remote areas of an underground mine, in and of itself, is expensive and time consuming. Moreover, in many areas of a mine, the portion of the mine tunnel to be closed may be of limited height or cross-sectional area, requiring a miner to carry the relatively heavy concrete blocks some distance in a crouched position or even on his hands and knees.

Prior art attempts to overcome some of the burdens associated with concrete block mine stopping have included the use of filled polyethylene bags or even foamed (rigid) polystyrene sheets coated with sealant. Unfortunately, each of these approaches have bad little or no practical success.

Therefore, it is evident that there is a great need for an improved mine stopping, one that can be readily constructed, even in difficult locations, in a simple and expeditious manner. It is this need with which the instant invention is concerned.

SUMMARY OF THE INVENTION

Accordingly, it is an object of the present invention to provide a mine tunnel air flow control device which can be erected quickly, is made of easily transportable material, and yet, which provides a rigid barrier wall that is air tight, flame resistant, and flexible enough to withstand a horizontal force of 39 lb/ft$^2$ or more.

Consistent with the foregoing, it is an object of this invention to provide a mine stopping formed of a sheet of strong, but flexible, polymeric material which extends across a framed opening and acts as a matrix or support for a coating of an air impermeable sealant applied to at least one side thereof to direct air flow in a predetermined direction away from a particular area of the mine.

It is another object of the present invention to provide a method for constructing a mine stopping by erecting a frame along the side walls, ceiling and floor of a tunnel which is spanned by a sheet of such matrix material and then coated with a paste-like or sprayable sealant to prevent air flow therethrough.

The matrix material is preferably available in roll form for ease in transportation, bendable or foldable in use to enable edge portions to be extended beyond the walls forming the mine tunnel opening for engagement with the roof, floor and side walls or ribs to improve the peripheral seal, and strong enough to support the sealant to be applied to one or both of its surfaces and withstand the pressure differential to which it may be subjected, and yet capable of receiving and anchoring the sealant These objectives may be accomplished by utilizing, as a primary matrix for the mine stopping, a flexible polymeric material in sheet or roll form having good tensile characteristics and a surface configuration capable of bonding to, and retaining, a coating of the flame retardant sealant. High strength woven or knitted structural textiles, such as disclosed in copending U.S. patent application Ser. Nos. 08/696,603 and 08/696,604 filed Aug. 14, 1996, and assigned to The Tensar Corporation of Morrow, Ga. ("Tensar"), the disclosure of each of which is incorporated herein by reference, are believed to provide satisfactory tensile and surface properties for use as a mine stopping matrix according to this invention.

From a practical standpoint, however, the preferred matrix material is a polymer grid composite comprised of a grid material, preferably a biaxially oriented integral geogrid, to which is bonded a textile material, preferably a non-woven geotextile. Grid composites have enhanced strength provided by the grid component, and are better able to anchor the sealant composition because of the high surface area and fine interstices of the non-woven geotextile. Additionally, since it is customary to bond the textile primarily to the junctions of the grid, the surface of the composite is not continuous as in a structural textile, making a composite easier to handle during the construction process.

The matrix material, regardless of form, is secured to a frame spanning the mine opening, preferably with edge portions extended beyond the frame onto the tunnel walls. Then, one or both sides of the matrix material, including the portions engaging the tunnel walls, are coated with a sealing material such as the aforementioned Sandvik sealant or a comparable material.

Particularly desirable grid composites useful as the preferred matrix for mine stoppings according to this invention are described in U.S. Pat. Nos. 5,199,825 and 5,277,520, assigned to Tensar, the disclosure of each of which is incorporated herein in its entirety by reference. The preferred grid composite is formed of an integral polymer geogrid which is typically heat bonded to an 4 to 8 oz./yd.$^2$, 100% continuous filament polyester non-woven needle punched engineering fabric. The engineering fabric or geotextile may be bonded to the polymer grid using an open flame heat source or by the use of a heated roll. Such grid composites are available from Tensar under product numbers GC 1200 or GC 3320.

The use of a grid composite as the primary support for the sealant provides a material which is easily transported to the site in precut sheet form, or in a roll, and readily handled, even in tight areas, to construct the mine stopping in situ. Such materials are relatively light weight, particularly when compared to cinder blocks, and very flexible. Yet, the polymer grid provides the composite with exceptionally high strength, the geotextile spans the grid openings and presents a surface finish to both sides of the composite (on one side through the grid apertures) which is especially well adapted to receive and bond with the sealant composition.

The polymer grid of the composite may desirably be a uniaxially or biaxially oriented integral structal geogrid of the type which is commercially available from Tensar. Such materials are preferably made by the process disclosed in U.S. Pat. No. 4,374,798. the subject matter of which is incorporated herein in its entirety by reference.

While a high density polyethylene biaxial integnal structural geogild of the type produced by the process disclosed in the '798 patent and sold by Tensar as its BX 1200 geogrid. is preferred. the grid may be formed of other polymeric materials, including other polyolefins, or various polyamides, polyesters or even fiberglass. Additionally, integral structural geogrids may be made by other techniques and various bonded composite open mesh structural textiles, including woven or knitted grid-like sheets such as disclosed in co-pending U.S. patent application Ser. Nos. 08/643,182 filed May 9, 1996, assigned to Tensar, the subject matter of which is incorporated herein in its entirety by reference, and the aforementioned application Ser. No. 08/696,604, may be readily adapted for use as the grid element of a composite matrix material in forming a mine stopping according to this invention.

The mine stopping should be at least flame retardant for obvious reasons. Since the sealant materials commonly in use, such as those available from Sandvik, are flame retardant, and since the matrix is preferably filly coated by the sealant, for many applications it is not necessary that the matrix also have flame retardant properties. However, the grid or mesh materials as well as the geotextile may be treated with, or incorporate, a fire or flame resistant or retardant material to preclude, or at least minimize, the possibility that a break in the sealant coating will enable the composite to initiate a spark or propagate a fire in a combustible underground environment such as a coal mine. Preferred grid materials having such characteristics are discussed in some detail in U.S. Pat. No. 5,096,335 issued Mar. 17, 1992, which is assigned to Tensar, the subject matter of which is also incorporated herein in its entirety by reference.

According to the present invention, a wood frame may be initially erected about the perimeter of a portion of a mine tunnel opening at the point where air flow is to be intercepted and redirected. The frame may be formed from 2 by 4 inch wood studs placed along the ceiling and floor of the tunnel with a plurality of spaced jacks expanded or wooden props wedged between the studs for support. Wood pieces may be secured to the jacks. at least those juxtaposed to the tunnel sidewalls, to complete the frame. The matrix material may then be secured to the wood frame in any desired manner as by nails or staples. At the side walls or ribs, ceiling and floor of the tunnel, if desired, steel spads or other anchors may be used to secure the matrix in place.

If the width of the matrix sheet is not adequate to span the frame, it may be necessary to overlap two or more sections of such material and connect the sections to each other by cable ties or the like.

Once sufficient matrix material is provided to substantially covet the tunnel opening, a sealant is used to coat at least one side, and preferably both sides, of the matrix and complete the mine stopping. In the final mine stopping, one side is likely to be isolated from view with limited access. Therefore, if it is desired to coat both sides of the matrix material, the worker must travel into the adjacent tunnel to gain access to the other side of is the stopping. Selected mine stoppings can be provided with doors for passage of workers, as needed.

The sealant is applied by hand, by glove, by trowel or by spraying preferably to an approximate thickness of 3/16 to 5/16 inch, although the thickness may be varied as necessary to insure an air tight seal. On the exposed surface(s) of the matrix material, the sealant preferably overlaps the same and continues onto the side walls, ceiling and floor for a distance of approximately 1 foot.

It will be readily recognized that the instant invention provides significant advantages over the principal prior art mine stopping technique of erecting a mortarless cinder block wall and coating the cinder blocks with a sealant. In addition to the reduced cost of transporting a matrix material such as a grid composite to the site, the manual labor time, and potential for injury in erecting a mine stopping according to this invention, is dramatically reduced.

The aforementioned and other objects of the instant invention, as well as many of the attendant advantages thereof, will become more readily apparent when reference is made to the following description taken in conjunction with the accompanying drawings wherein like parts are identified by like reference numerals.

BRIEF DESCRIPTION OF THE DRAWINGS

FIG. 6 is an enlarged detailed view of the overlapping portions of the grid composite sections illustrating the manner in which the sections may be secured to each other by cable ties or the like.

DETAILED DESCRIPTION OF THE PREFERRED EMBODIMENTS

Figure 1:
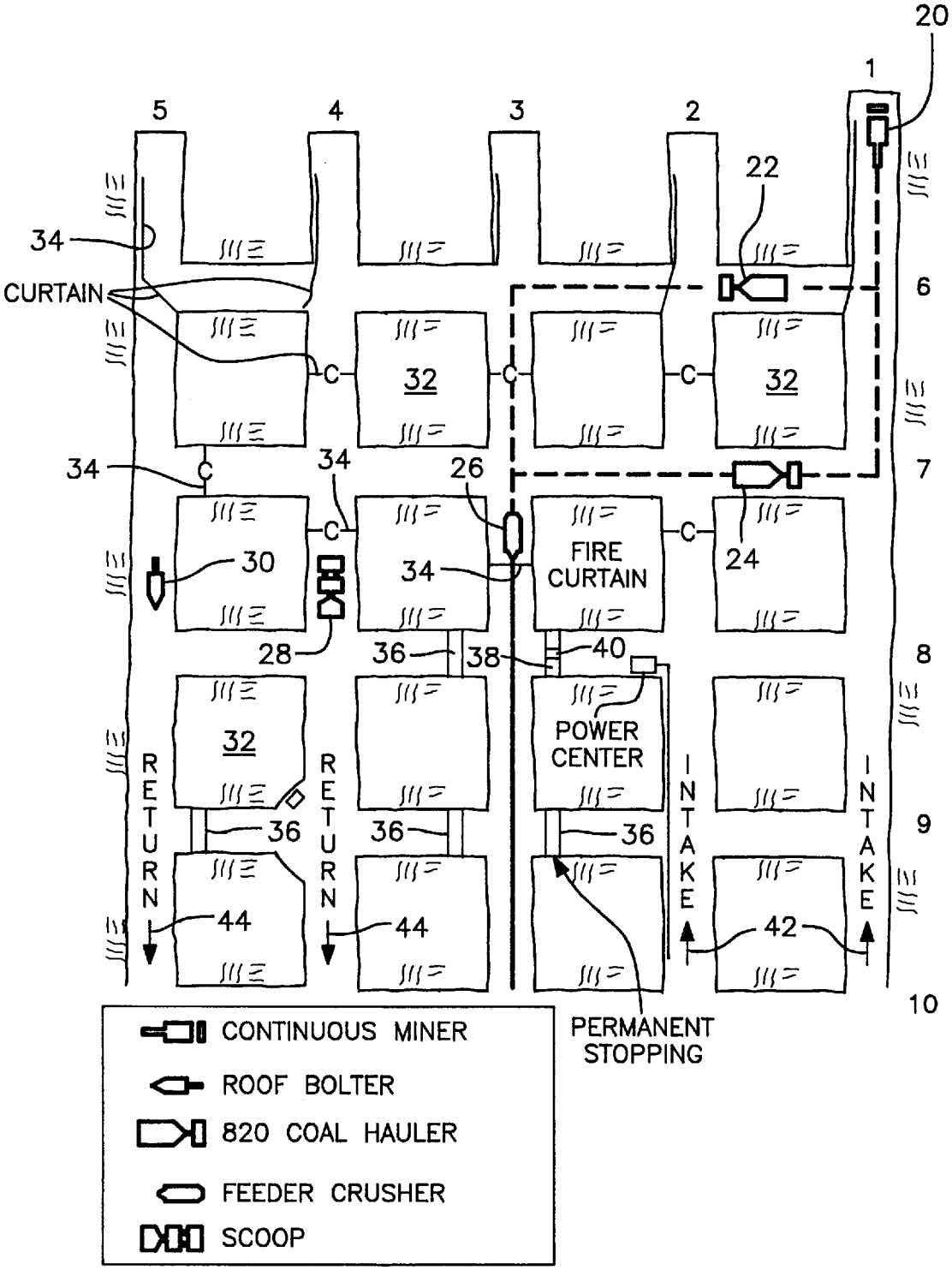
FIG. 1 is a schematic diagram of a room and pillar mine panel formed by a plurality of rows and columns of interconnected perpendicularly extending tunnels, showing the way in which air will flow through such an underground mine.

In describing a presented embodiment of the invention illustrated in the drawings specific terminology will be resorted to for the sake of clarity. However, the invention is not intended to be limited to the specific terms so selected, and it is to be understood that each specific term includes all technical equivalents which operate in a similar manner to accomplish a similar purpose.

Since grid composites are the preferred polymeric sheet matrices for mine stoppings according to this invention, whether the textile component is woven, knitted or nonwoven, the following detailed discussion and the drawings are primarily directed to the use of such materials.

With reference to the drawings in general, a schematic illustration of a room-and-pillar mining operation is shown in FIG. 1. It is to be understood that the instant inventive concepts are adaptable to direct air flow to working portions of one or more tunnels in an underground mine, and to prevent air short circuiting to exhaust airways regardless of the way in which the tunnels are formed. However, to facilitate understanding the environment in which such mine stoppings are used, and particularly the air how patterns in an underground mine, it is believed that the following discussion of a typical room-and-pillar mining operation will be helpful.

In FIG. 1, a plurality of mine tunnels are represented by columns numbered 1 though 5, shown extending generally parallel to each other. Extending generally perpendicularly to, and intersecting, the columns 1 through 5 are mine tunnels represented by rows 6 through 10. The columns and rows together form a plurality of pillars 3.

In this mining operation, a continuous miner 20 is advancing alone column 1 Following behind the miner 20 are coal haulers 22, 24 which transport coal to a feeder crusher 26. Additional equipment found in the mine scenario of FIG. 1 are a scoop 28 and a roof bolter 30.

Typically, located throughout such a mine are a plurality of air ventilation curtains 34 which allow passage of laborers and equipment, and direct fresh air ventilation to the working area of the mine. Additionally, one or more permanent or temporary stoppings, such as schematically shown at 36, may be located in the mine to prevent passage of air flow. The mine stopping 38 illustratively includes an access door 40 to allow passage therethrough of a miner, if necessary.

As shown by arrows 42, air may be introduced into the mine along columns 1 and 2. Due to the presence of mine stoppings 36, 38 in rows 8 and 9, air cannot migrate laterally into column 3 from columns 1 and 2. Instead, the ail flow is directed to the mining operation involving the miner 20 and coal haulers 22. Thereafter, the air flow migrates to columns 4 and 5 and is withdrawn in the direction of arrows 44 by an air exhaust system.

The direction of air flow in the mine is directly related to pathways open to its flow. Where permanent or temporary stoppings are located, air is prevented from flowing and therefore seeks a different path.

Figure 2:
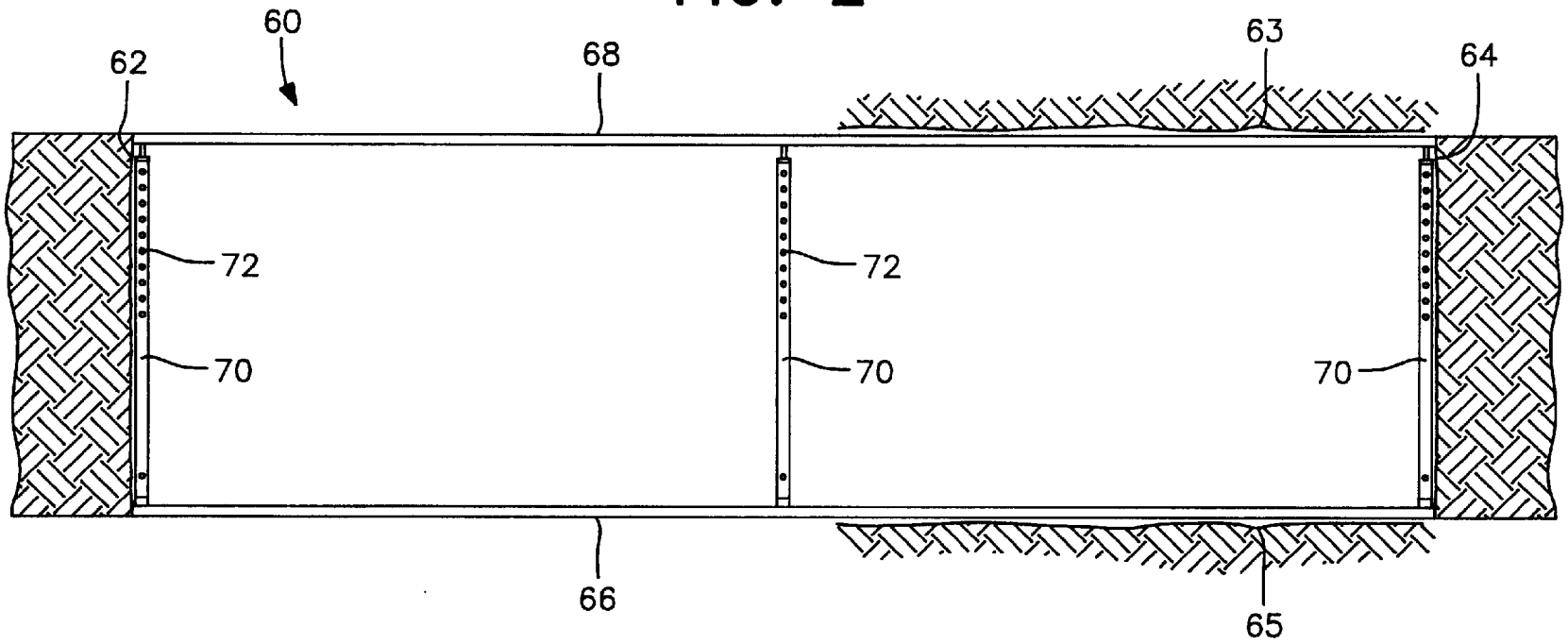
FIG. 2 schematically illustrates the first steps in erecting a frame across a tunnel opening from 2 by 4 inch horizontally extending floor and ceiling studs supported by vertically expandable jacks or wooden props in preparation for forming, a mine stopping according to this invention.
Figure 2A:
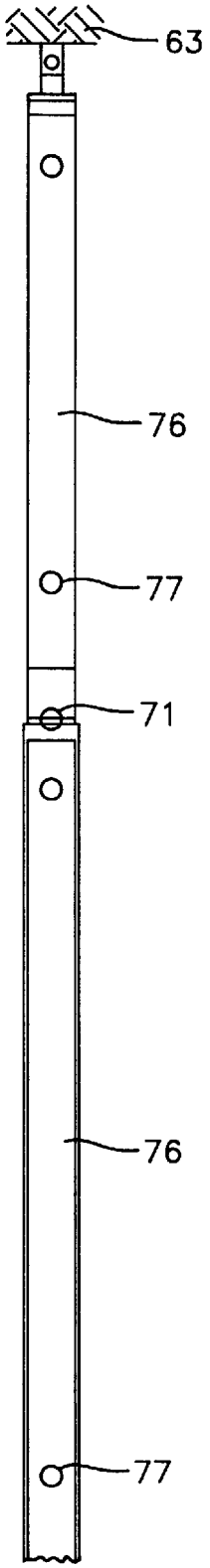
FIG. 2A is a front view of a jack showing wood studs secured thereto for attachment of a preferred matrix material.
Figure 2B:
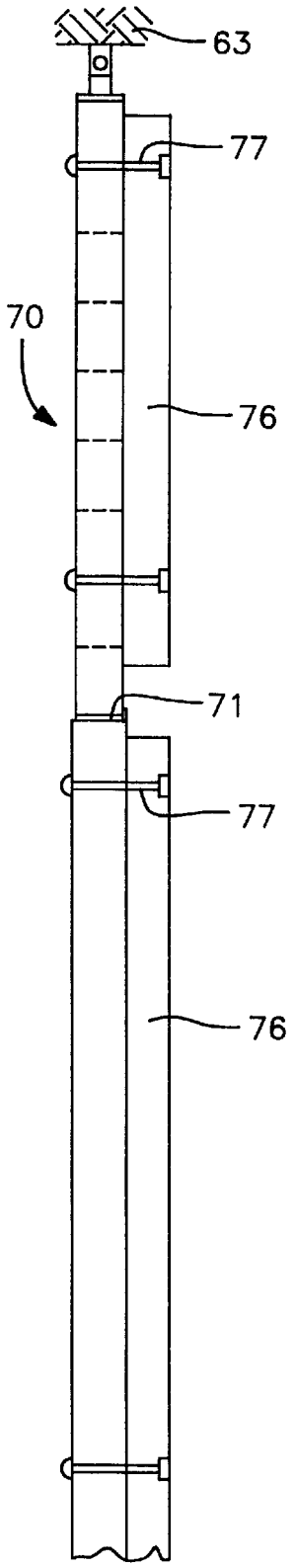
FIG. 2B is a side view thereof.

Whenever, it is necessary to block air from flowing through, and thereby direct the flow along a prescribed course, mine stoppings according to this invention may be erected. Refining now to FIGS. 2–7, the construction of a mine stopping according to the present invention across an opening 60 in a mine tunnel, will be discussed. The opening 60 is formed by side walls or ribs 62, 64, a ceiling 63 and a floor 65. A stud 66 formed of a 2×4 or the like is placed along the floor 65 and an opposed stud 68 is placed along the ceiling 63 of the mine tunnel. Interposed between the studs 66, 68 are a plurality of spaced jacks 70 which are elevatable to a height at which a pin 71 is slid into an opening 72 extending through telescoped portions of the jack so as to maintain the expanded position of the jack. In FIGS. 2A and 2B, wooden stud portions 76 may be secured to the telescoped sections of the jacks 70 by bolts 77 or in any other conventional manner. Wooden props cut to size and wedged into place (not shown) may also be used.

Of course, notwithstanding the schematic illustrations herein, in a typical mine the side walls, ceiling and floor are not perfectly planar. Thus, the studs 66, 68 and jacks 70 may be placed approximately 1.5 feet from these sidewalls, or whatever distance is convenient, to thereafter facilitate sealing the tunnel opening.

Figure 3:
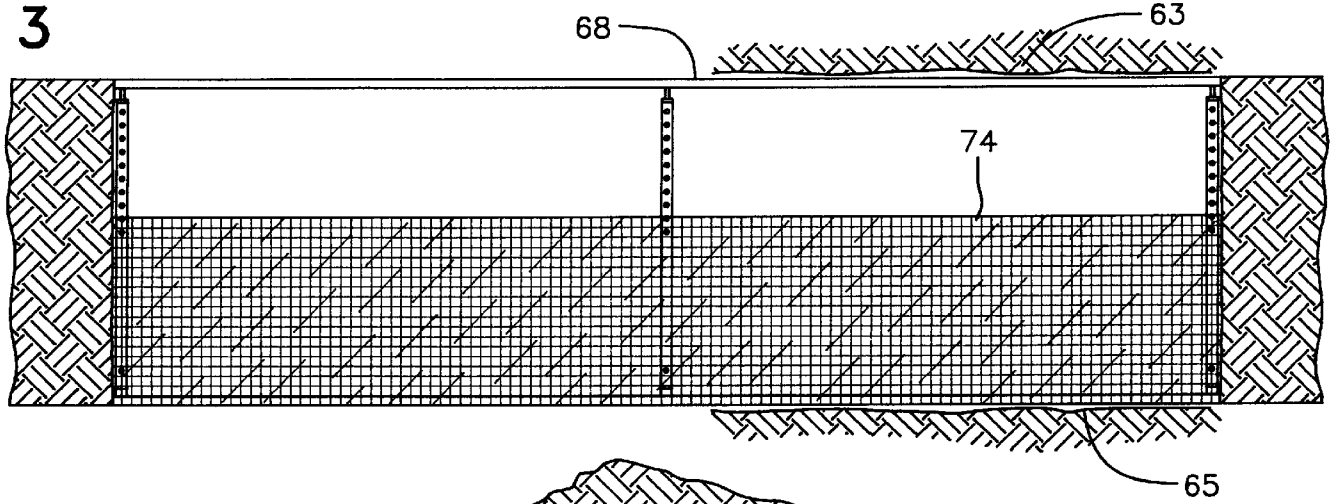
FIG. 3 illustrates the attachment of a first section of grid composite to the frame.
Figure 4:
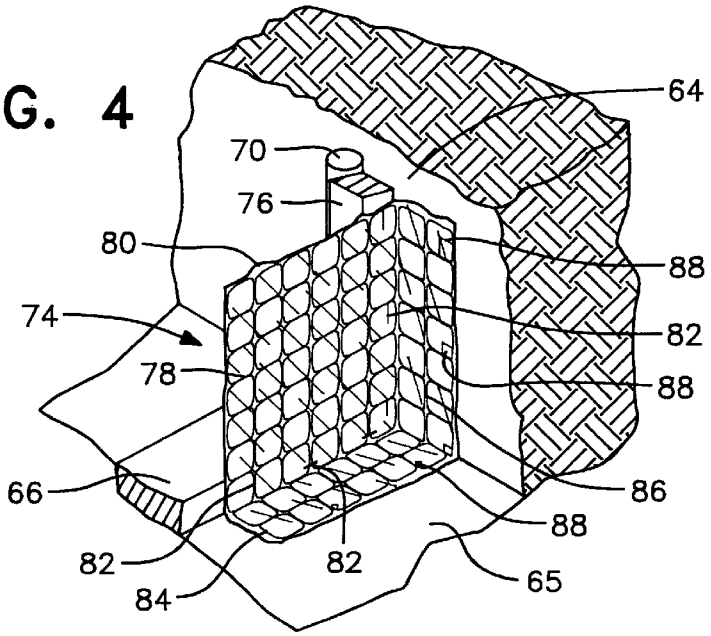
FIG. 4 is a partial perspective detailed view showing flow the grid composite is extended beyond the frame and secured to the floor and sidewall of the tunnel opening to insure a complete seal.

As shown in FIGS. 3 and 4, a length of grid composite 74 is vertically positioned and extended in a horizontal direction between the side walls 62, 64 of the tunnel opening 60. As seen particularly in FIG. 4, the preferred grid composite section 74 is formed of a sheet of geogrid 78 bonded to a sheet of geotextile 80. Edge positions of the grid composite 74 may be secured as by staples 82 or the like to the floor stud 66 and the lower stud portions 76 on the jacks 70. A peripheral bottom portion 84 of the grid composite 74 extends beyond the attachment to the floor stud 66 and may be anchored to the floor 65 by steel spads 88. Peripheral side portions 85 of the composite 74 may be secured to the sidewall or rib 64 of the opening 60 by additional spads 88. Similar extended peripheral portions of the grid composite 74 (not shown) may be secured to the opposite sidewall 62. and ultimately to the ceiling 63 of the tunnel opening 60.

Figure 5:
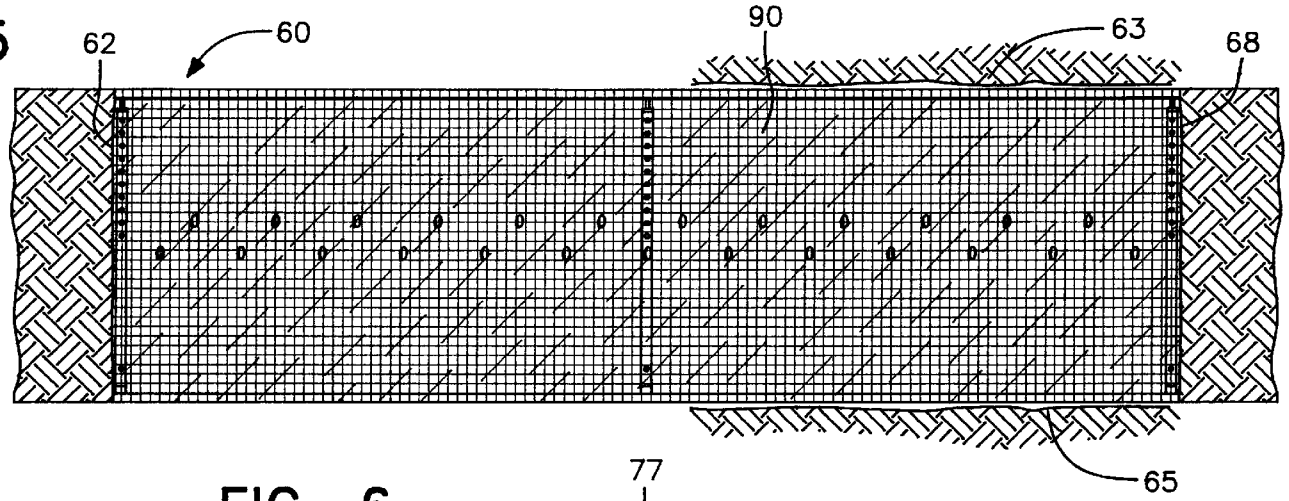
FIG. 5 illustrates the addition of a second section of grid composite across the frame to completely cover the tunnel opening.
Figure 6:
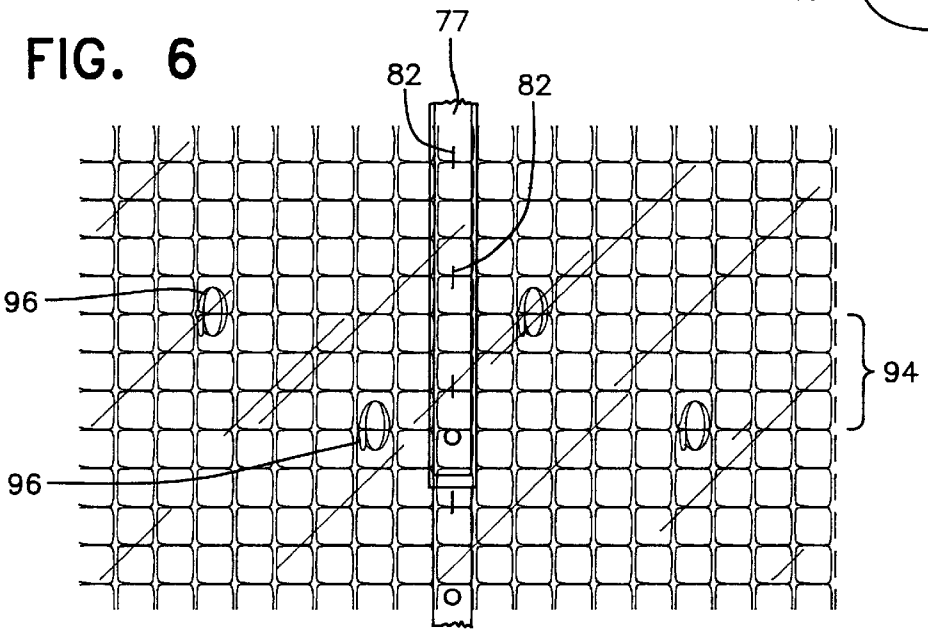

As shown in FIGS. 5 and 6, to complete blocking of the opening 60, a second horizontally extending, vertically oriented section 90 of grid composite may be secured to the ceiling stud 66, the ceiling 63, the upper stud portions 96 on the Jacks 70, and to the sidewalls 62, 64 in a similar manner. Overlapping positions 94 of the two sections 74, 90 of grid composite, may be secured to each other by cable ties 96, preferably engaged in offsetting rows along the length of the sections 74, 90 as shown in FIG. 6.

Obviously, if a single section of matrix material will cover the entire opening 60, multiple sections will not be needed. Additionally, if two sections of matrix do not fully cover the opening, further sections can be utilized in a similar manner.

Figure 7:
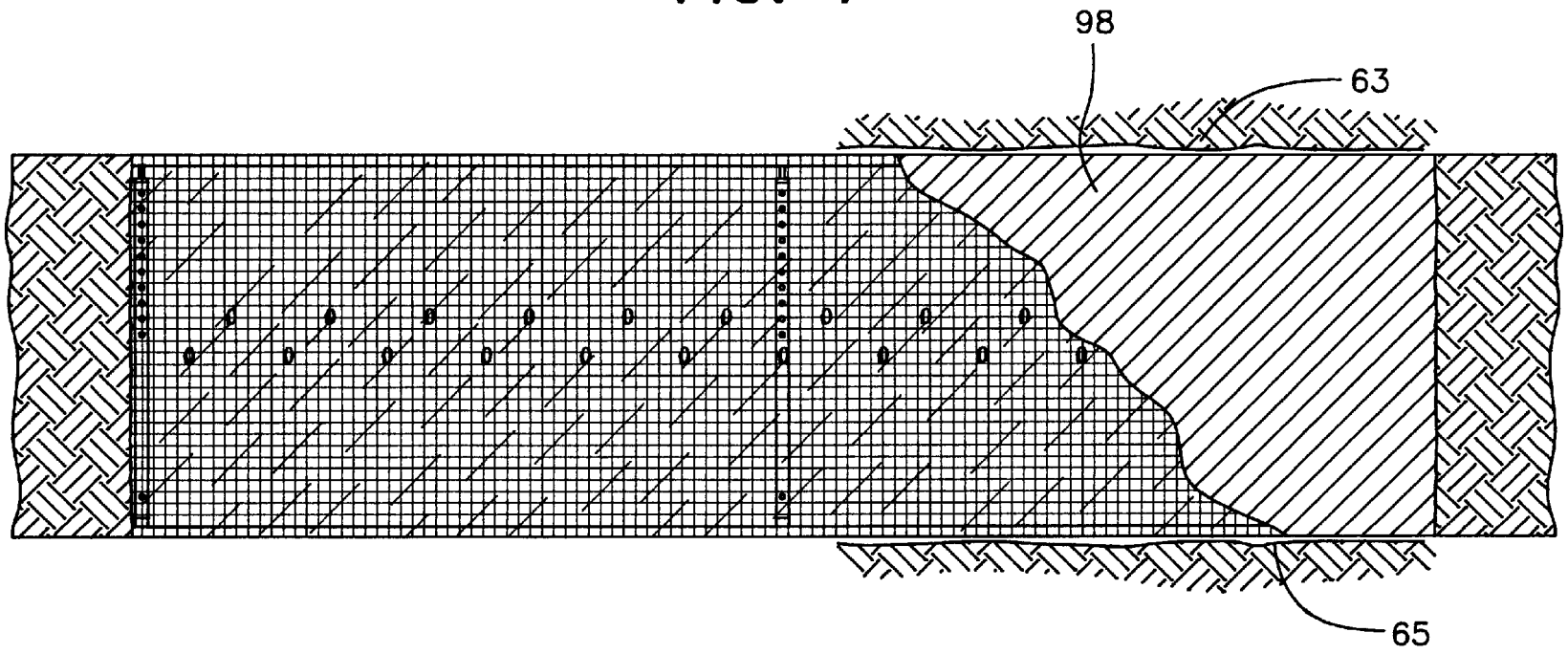
FIG. 7 schematically illustrates the application of a sealant layer to the grid composite to complete the air seal provided by the mine stopping of this invention.

To complete the fabrication of the mine stopping in situ, at least one, and preferably both sides of the sections 74, 90 of the grid composite are coated with a sealant 98. While sealant 98 is shown in FIG. 7 as only plurally covering, the sections 74, 90, it is understood that the entire width and height of the opening 60 from the floor to ceiling and sidewall to sidewall is to be covered with sealant. Also, any peripheral portions such as shown at 84, 85 of the grid composite, which extend over and onto the floor, ceiling and/or sidewalls are covered with sealant, and the sealant may be applied to the tunnel walls even beyond the edge portions of the grid composite to effect an air tight seal.

While the thickness of the one or both layers of sealant can be selected by those skilled in the art so as to completely block the passage of air and strengthen the mine stopping as needed, with the Sandvik sealant disclosed in the '019 or '499 patents it has been found that a layer of approximately 3/16 to 5/16 inch on each side of the composite is quite effective.

When the sealant is set, the opening of the tunnel will be sealed against air passage. A controlled ventilation of the mine can thereby be obtained by the erection of quick and less labor intensive mine stoppings than previously known.

The foregoing description should be considered as illustrative only of the principles of the invention. Since numerous modifications and changes will readily occur to those skilled in the all, it is not desired to limit the invention to the exact construction and operation shown and described, and, accordingly, all suitable modifications and equivalents may be resorted to, falling within the scope of the invention as defined by the appended claims.

We claim:

1. A mine stopping for preventing flow of air through a mine tunnel having a floor, a ceiling and opposed sidewalls, said mine stopping comprising:

a flexible sheet of polymeric matrix material extending between the floor, the ceiling and the opposed sidewalls of the tunnel, said polymeric matrix comprising a grid composite including a geogrid and a non-woven fabric geotextile, said geogrid comprising intersecting strands connected by nodes and defining a multiplicity of apertures, and said geotextile being bonded at least at said nodes and spanning said apertures, and a sealant composition covering at least one side of said sheet of matrix material and being anchored to said non-woven fabric geotextile to block air flow across said mine stopping.

2. A mine stopping as claimed in claim 1, wherein said sealant composition covers both sides of said sheet of matrix material and is anchored to both sides of said non-woven geotextile, directly on one side, and through said apertures of said geogrid on the opposite side.

3. A mine stopping as claimed in claim 1, wherein said geogrid comprises an integral biaxially oriented geogrid.

4. A mine stopping as claimed in claim 1, wherein said sealant composition includes about 1.8 to 28% by weight of said water soluble silicate, about 3.6 to about 50% of said water, about 0.01 to about 5% of said fibers, up to about 50% of said clay and about 1 to 73% of said limestone.

5. A mine stopping as claimed in claim 1, further including a frame extending peripherally about the ceiling, the floor and the opposed sidewalls of the mine tunnel, and wherein said sheet of matrix material is secured to said frame, portions of said sheet of matrix material overlapping said frame and being secured to corresponding portions of the ceiling, the floor and the opposed sidewalls of the mine tunnel, said portions of said sheet of matrix material being covered by said sealant composition.

6. In a method of controlling and directing air flow between portions of an underground mine having a plurality of generally horizontally extending tunnels, each of which includes a floor, a ceiling and opposed sidewalls, by constructing mine stoppings across selected tunnels, the improvement which comprises constructing said mine stoppings by:

erecting a peripheral frame along the floor, the ceiling and the sidewalls of a selected tunnel, securing a sheet of a polymeric matrix material to said frame to extend between said sidewalls from floor to ceiling of said tunnel, said polymeric matrix comprising a grid composite including a geogrid and a non-woven fabric geotextile, said geogrid comprising intersecting strands connected by nodes and defining a multiplicity of apertures, and said geotextile being bonded at least at said nodes and spanning said apertures, and applying a sealant composition to at least one side of said sheet of matrix material and anchoring said sealant composition to said non-woven fabric geotextile to prevent air flow across said mine stopping.

7. A method according to claim 6, wherein at least one mine stopping is constructed in a plurality of interconnected tunnels to direct the air flow to and from working areas of the mine.

8. A method according to claim 6, comprising applying said sealant composition to both sides of said grid composite, said sealant being anchored to one face of said non-woven fabric geotextile through said apertures of said geogrid and also being anchored to the opposite face of said non-woven fabric geotextile.

9. A method according to claim 6, comprising extending peripheral portions of said sheet of matrix material beyond said frame, securing said extended portions of said sheet of matrix material to said sidewalls, floor and ceiling of said tunnel, and applying sealant composition to said peripheral portions of said sheet of matrix material to insure an air tight mine stopping.

10. A method according to claim 6, wherein said sealant composition comprises from about 1.8 to about 20% by weight of a water soluble silicate, about 3.6 to about 46% water, about 0.01 to about 0.3% fibers, up to about 48% clay, and about 1 to about 73% limestone, and said sealant is applied to said sheet of matrix material by hand.

11. A method according to claim 6, wherein said sealant composition comprises from about 1.8 to about 28% by weight of a water soluble silicate, about 3.6 to about 50% water, about 0.08 to about 5% fibers, up to about 50% clay, and about 1 to about 73% limestone, and said sealant is applied to said sheet of matrix material by spraying.

* * * * *